US012687005B2

(12) United States Patent
Meyers et al.

(10) Patent No.: US 12,687,005 B2
(45) Date of Patent: Jul. 21, 2026

(54) FLOOR DRAIN SYSTEM

(71) Applicant: EBBE AMERICA, LC, Clearfield, UT (US)

(72) Inventors: Lawrence G. Meyers, Clearfield, UT (US); Alden S. Meyers, Clearfield, UT (US)

(73) Assignee: EBBE AMERICA, LC, Clearfield, UT (US)

( * ) Notice: Subject to any disclaimer, the term of this patent is extended or adjusted under 35 U.S.C. 154(b) by 146 days.

(21) Appl. No.: 18/144,499

(22) Filed: May 8, 2023

(65) Prior Publication Data

US 2023/0366193 A1 Nov. 16, 2023

Related U.S. Application Data

(60) Provisional application No. 63/341,952, filed on May 13, 2022.

(51) Int. Cl.
*E03F 5/04* (2006.01)

(52) U.S. Cl.
CPC ..... *E03F 5/0409* (2013.01); *E03F 5/0408* (2013.01)

(58) Field of Classification Search
CPC ..... E03F 5/0409; E03F 5/0408
See application file for complete search history.

(56) References Cited

U.S. PATENT DOCUMENTS

| | | | | |
|---|---|---|---|---|
| 2,783,852 | A * | 3/1957 | Sisk | E03F 5/0409 210/462 |
| 2,859,452 | A * | 11/1958 | Seewack | E03F 5/0409 210/165 |
| 4,067,072 | A | 1/1978 | Izzi | |
| 4,694,513 | A * | 9/1987 | Kiziah | E03F 5/0408 285/136.1 |
| 5,216,767 | A | 6/1993 | Elmore | |
| 6,687,925 | B2 * | 2/2004 | Minnick | E03F 5/0407 4/286 |
| 7,624,759 | B1 * | 12/2009 | Ismert | E03C 1/22 4/293 |
| 8,152,173 | B2 | 4/2012 | Oldani et al. | |
| 8,230,535 | B2 * | 7/2012 | Kik, Sr. | A47K 3/405 4/613 |
| 9,334,181 | B2 | 5/2016 | Worth et al. | |
| 9,848,742 | B2 * | 12/2017 | Phillips | A47K 3/405 |
| 10,167,622 | B2 | 1/2019 | Brooks et al. | |
| 10,676,911 | B2 | 6/2020 | Erlebach | |
| 10,962,282 | B2 | 3/2021 | Kim et al. | |
| 11,946,241 | B2 * | 4/2024 | Lorkowski | E03F 5/0409 |
| 2021/0372104 | A1 | 12/2021 | Meyers et al. | |

* cited by examiner

*Primary Examiner* — Angelisa L. Hicks
(74) *Attorney, Agent, or Firm* — Workman Nydegger

(57) ABSTRACT

A floor drain system includes a drain body having a drain opening arranged for attachment to a drain pipe and installation in a subfloor. A clamping collar is arranged for securing a waterproof layer to the drain body. The drain body includes a plurality of fastener receiving structures along an inner side of the drain opening for receiving a plurality of fasteners to attach the clamping collar to the drain body and seal the waterproof layer between the drain body and the clamping collar.

17 Claims, 7 Drawing Sheets

FLOOR DRAIN SYSTEM

TECHNICAL FIELD

The disclosure relates to a floor drain system for improved installation in a tile floor.

BACKGROUND

A floor drain in its simplest form is a drain body or structure which will funnel liquids from the top of a floor to a drain pipe. Typically, these floor drains have drain grate attached to the top thereof to allow liquid to flow therethrough but to prevent larger solid objects from entering the drain pipe.

A problem associated with the construction of all floor drains, including clamping collar drains, is one of attaching the drain body to the drain pipe. Because the drain pipe is often located below a subfloor (e.g., a wood subfloor or a concrete subfloor), a cutout must be made in the subfloor to access the drain pipe and install the drain body. This can be time-consuming and notoriously difficult. Another problem associated with the construction of floor drains installed in a tile floor is weep drainage and waterproofing. Installation mistakes can result in trapped weep water, costly leaks, and significant property damage.

Accordingly, there is a need for a floor drain system that incorporates certain design improvements over other systems for streamlined and improved installation in a tile floor.

SUMMARY

Embodiments of the present disclosure provide a floor drain system for streamlined and improved installation on a drain pipe or other pipe member. According to an embodiment, a floor drain system includes a drain body including a drain opening and arranged for attachment to a drain pipe and installation in a subfloor. A clamping collar is arranged for securing a waterproof layer to the drain body. The drain body includes a plurality of fastener receiving structures along an inner side of the drain opening for receiving a plurality of fasteners to attach the clamping collar to the drain body and seal the waterproof layer between the drain body and the clamping collar.

Because the fastener receiving structures are located inside the drain opening, an installer can install the drain body in a simple and closely fitting cutout in the subfloor, improving the installation process. This also can better support the drain body on the subfloor relative to prior art cutouts that are oversized relative to the drain body.

According to a variation, each of the fastener receiving structures include a heel portion extending upward along a radial inner side of the fastener receiving structure. The heel portions tilt a portion of a flange section on the clamping collar toward the drain body to increase a seal formed by the waterproof layer between the drain body and the clamping collar when the clamping collar is tightened onto the drain body.

BRIEF DESCRIPTION OF THE DRAWINGS

These and other features, aspects, and advantages of the present disclosure will become better understood regarding the following description, appended claims, and accompanying drawings.

Figure 2:
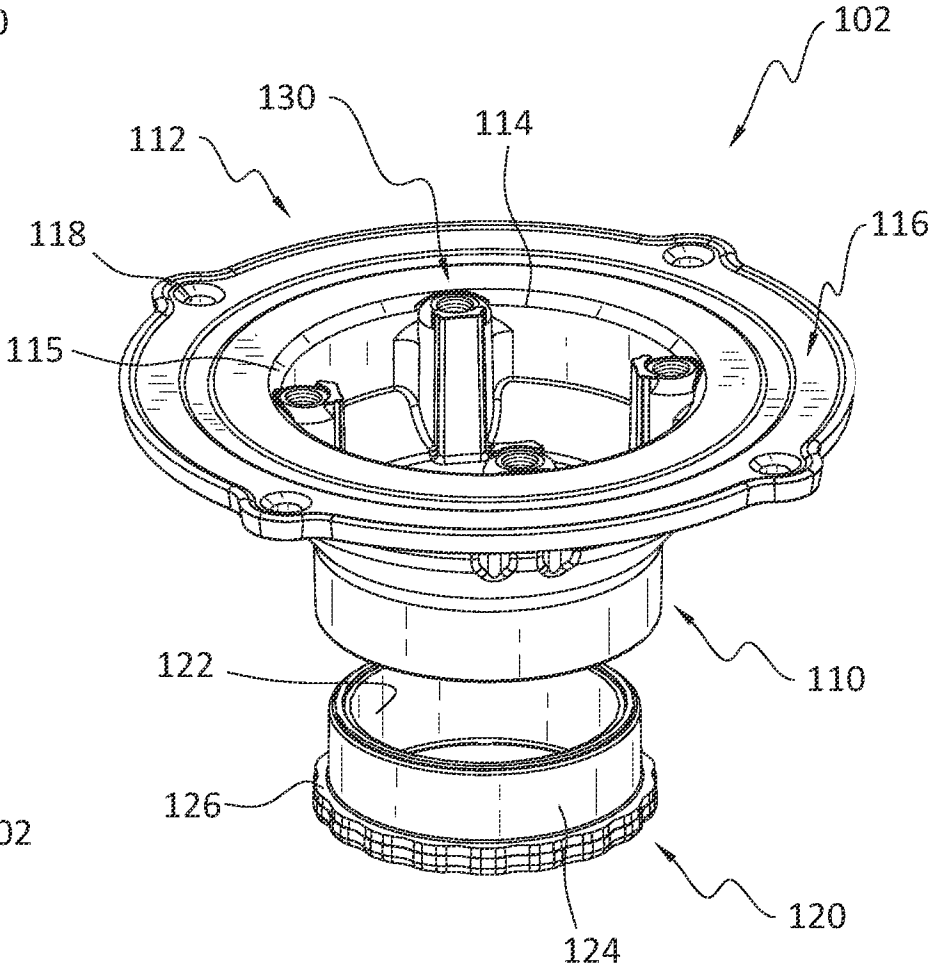
FIG. 2 is an exploded view of the drain body of FIG. 1.

The drawing figures are not necessarily drawn to scale, but instead are drawn to provide a better understanding of the components, and are not intended to be limiting in scope, but to provide exemplary illustrations. The figures illustrate exemplary configurations of drain systems, and in no way limit the structures or configurations of a drain system and components according to the present disclosure.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this application to possess a described meaning, there is no intent to limit the meaning of such term, either expressly or indirectly, beyond its plain or ordinary meaning.

Figure 1:
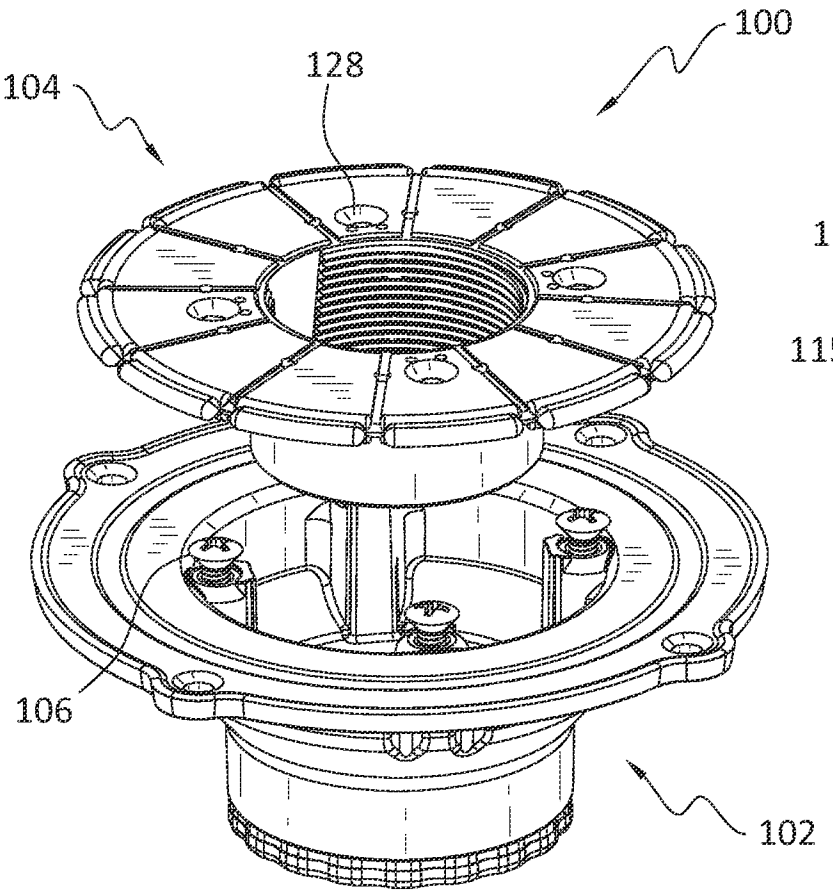
FIG. 1 shows a perspective exploded view of a floor drain system according to an embodiment.

Embodiments of the present disclosure advantageously provide a floor drain system that incorporate certain design improvements over other systems for streamlined and improved installation of the system in a tile floor. FIGS. 1-9 illustrate a floor drain system 100 comprising a clamping collar drain system including a drain body 102 and a clamping collar 104 according to an embodiment. As seen in FIG. 1, a lower portion of drain body 102 can be arranged for attachment to a drain pipe and the clamping collar 104 is arranged to be coupled to the top of the drain body 102 via fasteners 106. The drain body 102 and clamping collar 104 can be fabricated from ABS, PVC, metal, or any other suitable materials.

To create a watertight seal between the drain body 102 and the clamping collar 104, a waterproof layer 108 (shown in FIG. 7) can be located between the drain body 102 and the clamping collar 104. The waterproof layer 108 can comprise a waterproofing membrane, a pan liner, and or a gasket and can be made of any suitable material, but typically comprises a flexible or elastic material, permitting the waterproof layer 108 to generally conform to an underlying surface. In other embodiments, the waterproof layer 108 can comprise one or more layers of hot asphalt and felt paper applied by the installer. The waterproof layer 108 can include a drain opening and can be sandwiched between the drain body 102 and the clamping collar 104, forming a watertight seal therebetween. In some embodiments, the drain opening can be cut into the waterproof layer 108 by an installer.

Referring to FIG. 2, the drain body 102 can include a lower portion 110 comprising a cylindrical portion defining an outlet and configured for attachment to a drain pipe, and an upper portion 112 having a circular configuration defining a drain opening 114 and a flange section 116 surrounding the drain opening 114. As discussed below, the drain opening 114 can be sized and shaped to selectively receive a cylindrical section 142 of the clamping collar 104.

Optionally, the flange section 116 can define a plurality of openings 118 configured to receive one or more fasteners for attaching the drain body 102 to a subfloor. In other embodiments, the openings can be omitted, and the flange section 116 can be attached to the subfloor or a substrate via other methods such as via adhesives or thinset mortar. The drain body 102 and the clamping collar 104 are described having a circular shape but can have any suitable shape. For instance, the drain body 102 and or the clamping collar 104 can have a square shape, a rectangular shape, an oval shape, or any other suitable shape.

In an embodiment, a connector 120 can be positionable in the outlet of the lower portion 110. The connector 120 includes a tubular body defining an inner surface 122 configured to interface with the pipe member, and an outer surface 124 facing away from the inner surface 122 and configured to interface with and attach the connector 120 to the lower portion 110. The inner surface of the connector 120 includes a first pipe attachment portion formed of a pipe interfacing material. For instance, the pipe interfacing material can comprise ABS. A drain attachment portion of the outer surface 124 of the connector 120 can be formed of the same material of the lower portion 110. In an embodiment, the connector 120 can be interchangeable to allow the drain body 102 to attach to distinct types of pipe members. For instance, if the pipe member and drain body 102 are formed of PVC, the pipe interfacing material and the drain attachment portion can comprise PVC. If the pipe member and the drain body 102 are formed of ABS, the pipe interfacing material and the drain attachment portion can comprise ABS. If the pipe member is formed of ABS and the drain body is formed of PVC, the pipe interfacing material can comprise ABS and the drain attachment portion can comprise PVC. If the pipe member is formed of PVC and the drain body is formed of ABS, the pipe interfacing material can comprise PVC and the drain attachment portion can comprise ABS.

The connector 120 can be attachable to the lower portion 110 via a seal weld, adhesives, or any other suitable means. The interchangeability of the connector 120 advantageously allows the drain body 102 to be attached to either ABS pipe or PVC pipe using the drain body 102 rather than requiring multiple drain bodies, highly specialized solvents, or complicated attachment systems, as in the prior art. This simplifies the versatility of the floor drain system 100, which in turn, streamlines installation processes. Optionally, the outer surface 124 can define a shoulder 126 configured to interface with a bottom of the outlet of the drain body 102, advantageously helping to properly locate the connector 120 in the outlet.

Referring still to FIG. 2, a plurality of fastener receiving structures 130 including threaded openings 132 are located radially inside of the drain opening 114. As discussed herein, the clamping collar 104 allows for securing the waterproof layer 108 on the top of the drain body 102, by clamping the clamping collar 104 down on the drain body 102 using the fasteners 106 through the openings 128 in the flange section 144 of the clamping collar 104 and the fastener receiving structures 130 of the drain body 102. More particularly, the clamping collar 104 can be installed on top of the drain body 102 and the fasteners 106 can be inserted through the openings 128 and threadedly attached to the drain body 102 via the fastener receiving structures 130 inside the drain opening 114. While the fastener receiving structures 130 are shown comprising four fastener receiving structures, it will be appreciated that in other embodiments two, three, five, or any other suitable number of fastener receiving structures are possible.

Figure 4:
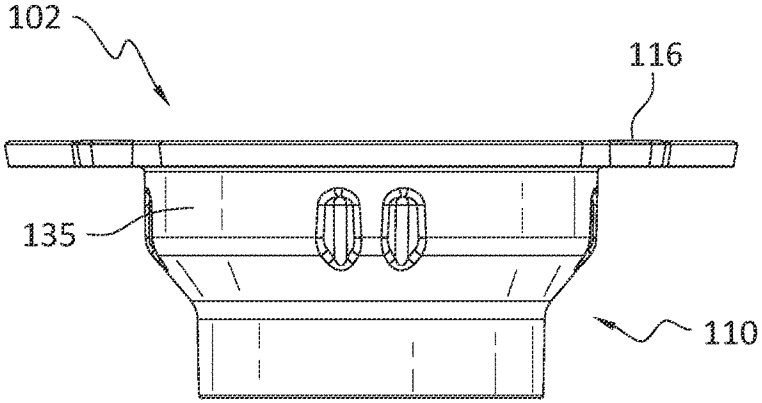
FIG. 4 shows a side view of the drain body of FIG. 1.
Figure 3:
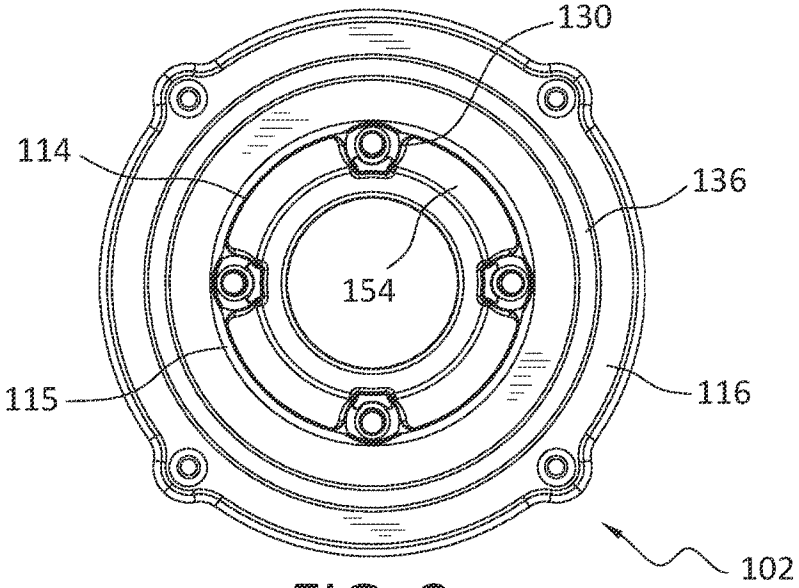
FIG. 3 shows a top view of the drain body of FIG. 1.

The arrangement of the fastener receiving structures 130 along the inner wall or inside of the drain opening 114 allows an outer surface 135 of the lower portion 110 below the flange section 116 to be generally circular, cylindrical, or of a standard shape as shown in FIG. 4. This is advantageous over prior art systems (see FIG. 5 for example) because prior art systems have protruding structures (A) located radially outside of the drain opening, which form interfering irregularities along the outer surface of the lower portion. Such interfering irregularities undesirably require an installer to make complicated cutouts in the subfloor, requiring considerable time and skill, or to oversize a cutout to accommodate the irregularities, increasing the likelihood of leaks or structural problems. The fastener receiving structures 130 of the present disclosure beneficially allow an installer to install the drain body 102 in a simple and closely fitting cutout around the lower portion 110 in a subfloor, improving the installation process. This also better supports the drain body 102 on the subfloor relative to prior art cutouts that are oversized relative to the lower portion 110 and/or angled. For instance, a closer fitting cutout advantageously increases a contact area between the subfloor and an underside of the flange section 116, which, in turn, can help stabilize the drain body 102 on the subfloor. In an embodiment, the underside of the flange section 116 can be substantially flat or planar. The positioning of the fastener receiving structures 130 inside of the drain opening 114 also make it easier for an installer to cut a drain opening in a waterproof layer 108. For instance, in prior art drain bodies with fastener holes outside of the drain opening, an installer must use tools or other methods to separately locate and cut out openings for the fastener holes underlying the waterproof layer 108 in additional to the drain opening. In the present disclosure, the installer can run a blade or other tool around an upper edge 115 (best shown in FIG. 6) of the drain opening 114 to form the drain opening in the waterproof layer 108 and expose the fastener receiving structures 130. The upper edge 115 can be chamfered, radiused, angled, or otherwise softened. In embodiment, clearances 117 are located on the radial outer side of the fastener receiving structures 130 at or near the upper edge 115 to accommodate the blade or tool. This beneficially simplifies installation of the waterproof layer 108 and eliminates the guesswork of locating hidden fastener openings under the waterproof layer 108 as required in the prior art.

Additionally, the arrangement of the fastener receiving structures 130 inside the drain opening 114 advantageously allows the lower portion 110 to fit inside and or cooperate with a fire suppression sleeve, streamlining installation of the floor drain system 100 in jurisdictions or applications where fire suppression sleeves may be required. Prior art clamping collar drain systems have been incompatible with such fire suppression sleeves or required additional components or modifications.

Because the fastener receiving structures 130 are located radially inside of the drain opening 114, the fastener receiving structures 130 support and or locate the clamping collar 104 on the drain body 102 rather than a sidewall of the drain opening 114. The fastener receiving structures 130 thus form the interface with the clamping collar 104 in the drain opening 114, if any.

Figure 6:
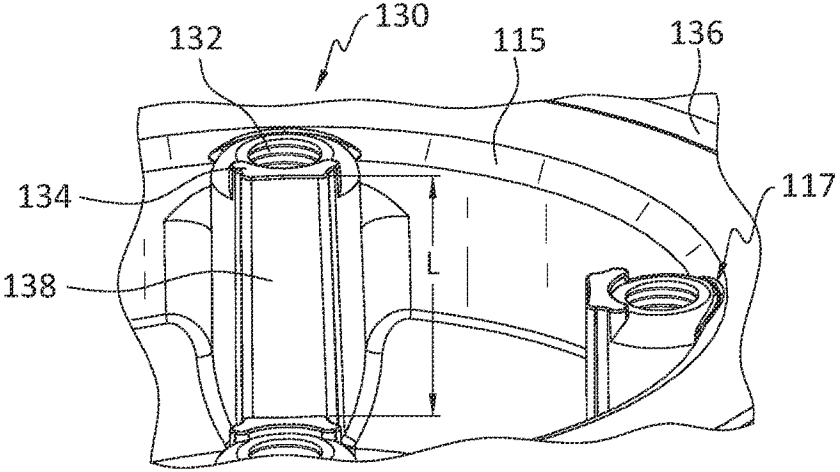
FIG. 6 shows a detailed view of the drain body of FIG. 1.
Figure 5:
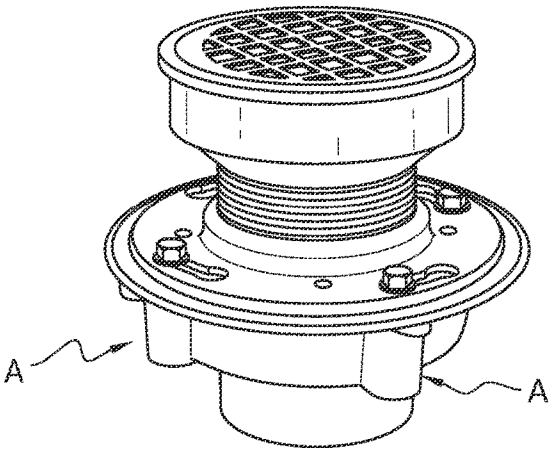
FIG. 5(PRIOR ART)
FIG. 5 shows a perspective view of a prior art clamping collar drain.
Figure 7:
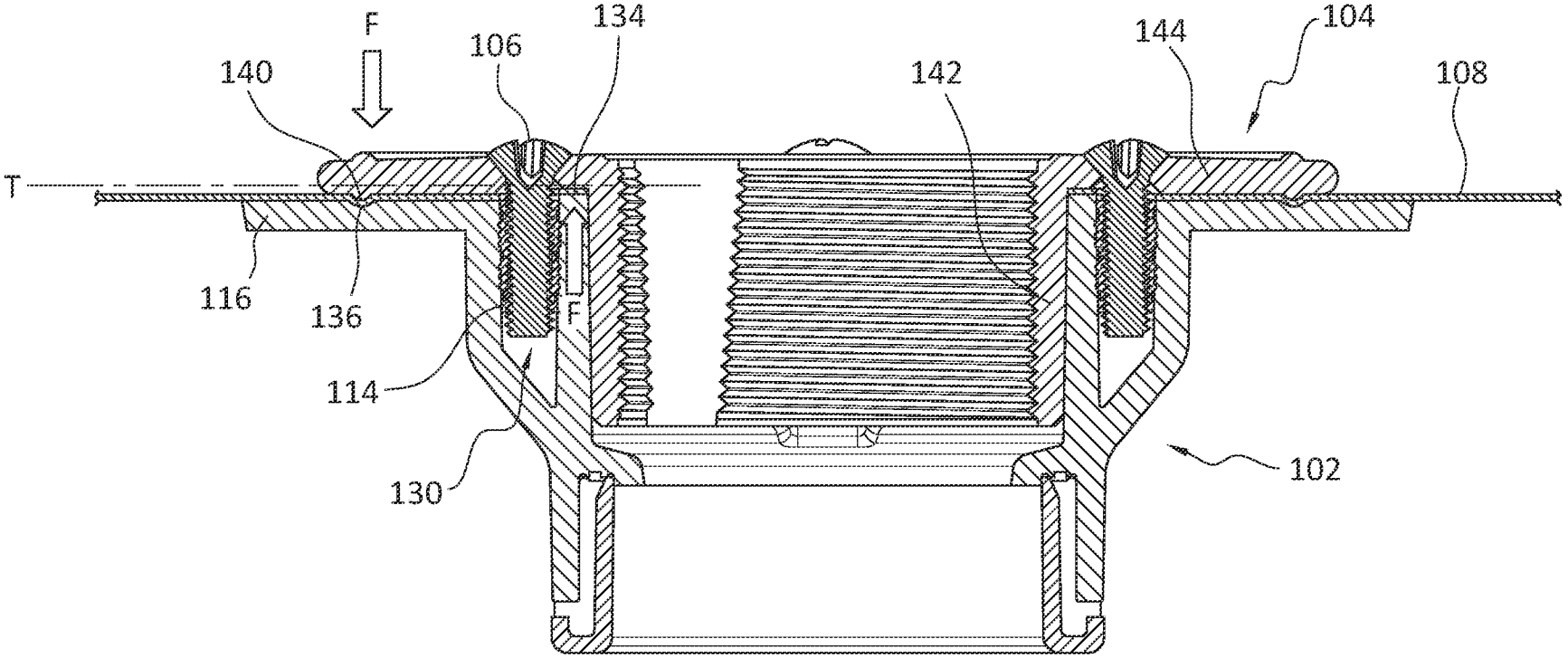
FIG. 7 shows a cross-section view of the system of FIG. 1.

Referring to FIG. 6, one or more of the fastener receiving structures 130 can include a raised part or heel portion 134 extending upward or beyond the threaded opening 132 along the radial inner side of the fastener receiving structure 130. When the clamping collar 104 is clamped onto the top of the flange section 116 of the drain body 102 via tightening of the fasteners 106, engagement of the clamping collar 104 against the heel portions 134 can tip or angle T a flange section 144 the clamping collar 104 relative to the flange section 116 of the drain body 102 as shown in FIG. 7. This tilting of the clamping collar 104 can force a portion of the flange section 144 toward or into the flange section 116, increasing a clamping force between the drain body 102 and clamping collar 104. This advantageously can increase the seal formed by the waterproof layer 108 sandwiched between the clamping collar 104 and the drain body 102, improving the waterproofing of the floor drain system 100 and reducing the likelihood of leaks. In other embodiments, one or more of the fastener receiving structures 130 can include the heel portions 134.

Optionally, the flange section 116 can define a recessed groove 136 (shown in FIGS. 3 and 7) extending circumferentially around the flange section 116. The recessed groove 136 can be sized and configured to receive a sealant before installing the waterproof layer 108. The recessed groove 136 can be sized and positioned to receive a protruding portion 140 extending around the clamping collar 104 and corresponding to the recessed groove 136. When the heel portions 134 tilt the clamping collar 104 downwardly toward the top of the flange section 116, the protruding portion 140 drives the waterproof layer 108 into the sealant and the recessed groove 136 (shown in FIG. 7), improving the seal between the clamping collar 104 and the drain body 102. This advantageously also increases a contact area between the clamping collar 104 and the drain body 102 and the waterproof layer 108 and the length of a potential flow path between the clamping collar 104 and the drain body 102.

It will be appreciated that the size, shape, and or configuration of the heel portions 134 can be varied or selected based on the thickness or other properties of the waterproof layer 108. For instance, if the waterproof layer 108 has a greater thickness, a height of the heel portions 134 can be increased to accommodate and work with the waterproof layer 108. A top surface of the heel portions 134 can be arranged to reduce the likelihood of puncturing or damaging the waterproof layer 108.

Referring still to FIG. 6, the fastener receiving structures 130 can have an elongate configuration defining a length L and width selected to support the clamping collar 104 on the drain body 102. In an embodiment, a collar interface surface 138 extends axially along the inner side of the fastener receiving structures 130.

The collar interface surface 138 can help support, locate, and transfer forces between the drain body 102 and the clamping collar 104. For instance, each of the collar interface surfaces 138 can define a radius of curvature substantially corresponding to a radius of curvature of a cylindrical section 142 of the clamping collar 104 and extend along an imaginary circumference substantially corresponding to an outer circumference of the cylindrical section 142 of the clamping collar 104. This advantageously helps locate the barrel in the drain opening 114 and helps limit lateral movement of the clamping collar 104 relative to the drain body 102 when the two are attached.

Figure 8:
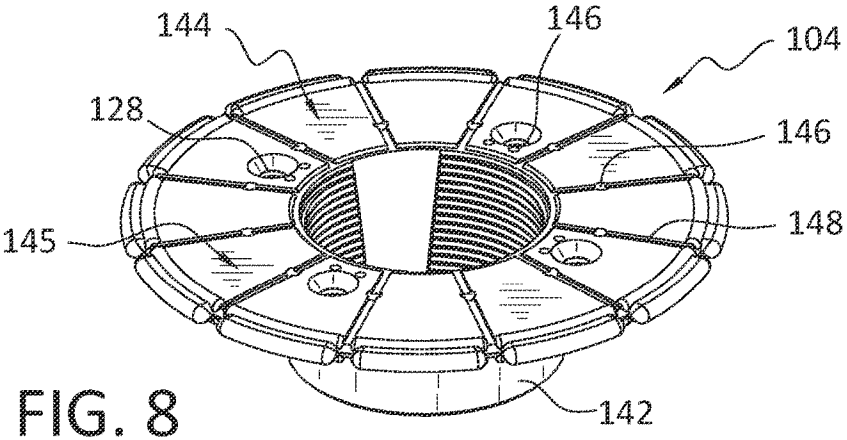
FIG. 8 shows a perspective view of the clamping collar of FIG. 1.
Figure 9:
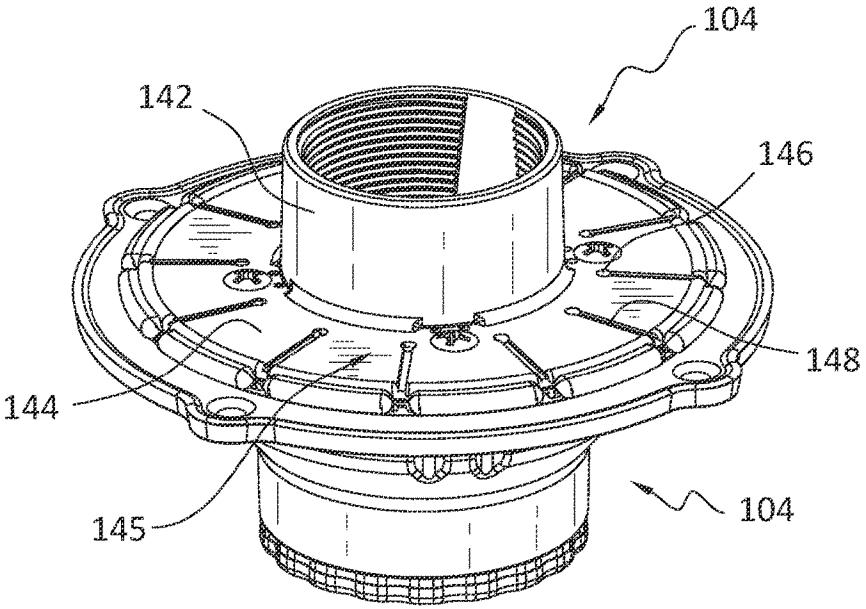
FIG. 9 shows another perspective view of the clamping collar of FIG. 1.

The clamping collar 104 will now be described in more detail in reference to FIGS. 8-10. The clamping collar 104 includes the cylindrical section 142 extending from a flange section 144. As described above, the clamping collar 104 allows for securing the waterproof layer 108 on the top of the drain body 102, by clamping the clamping collar 104 down on the drain body 102 using the fasteners 106 through the openings 128 in the flange section 144. The cylindrical section 142 can include internal or female threads to accept the external or male threads provided on a drain riser or other drain component. This allows for vertical up and down height adjustment of the floor drain system 100 in relation to the floor surface. This beneficially facilitates installation of the drain rise in conjunction with the floor, which may vary in height depending on the type of flooring materials being used. In the illustrated embodiment, cylindrical section 142 includes an outer surface without threads.

In the illustrated embodiment, the clamping collar 104 is reversible in relation to the drain body 102. For example, the cylindrical section 142 of the clamping collar 104 can extend downwards in the drain opening 114 of the drain body 102 (as shown in FIG. 7) or upwards in relation to the drain body 102 (as shown in FIG. 9). This reversibility of the clamping collar 104 allows for a larger range of height adjustment of the drain riser in relation to the floor surface, without the need of additional components to accommodate a larger range of height adjustments.

The clamping collar 104 one or more weep features 145 for improving drainage of the floor drain system 100. The weep features 145 can include a plurality of weep holes 146, a plurality of recessed channels 148, a plurality of segments 150, and or a plurality of gates 152. The weep holes 146 can extend through the flange section 144. The recessed channels 148 extend radially along one or more sides of the flange section 144. Some of the weep holes 146 can be positioned in the recessed channels 148 and other of the weep holes 146 can be located outside of the recessed channels 148. The recessed channels 148 form spaces or flow paths between the waterproof layer 108 and the flange section 144. It will be appreciated the clamping collar 104 can include any suitable number of weep holes 146 and or recessed channels 148. In the illustrated embodiment, the clamping collar 104 includes the drain features on the upper and underside of the flange section 144.

In the illustrated embodiment, the recessed channels 148 have a generally rectangular cross section. The recessed channels 148 can extend substantially between an outer periphery of the flange section 144 and the cylindrical section 142 along the side of the flange section 144 opposite the cylindrical section 142. On the side of the flange section 144 facing the cylindrical section 142, the recessed channels 148 extend between the outer periphery of the flange section 144 and a weep hole forming a terminal end of the recessed channel along the flange section. As weeping water reaches the clamping collar 104, the water can flow through the clamping collar 104 toward the drain pipe via the weep holes 146 and or the recessed channels 148.

The segments 150 can extend around the outer periphery of the flange section 144. The segments 150 extend outward from the flange section 144 and are arranged to extend a distance over the waterproof layer 108. The segments 150 can be separated by a plurality of indents or gaps defined between the segments 150 around the flange section 144. The shape and or number of segments 150 and gaps can vary. Moreover, the segments 150 and or gaps can have varied sizes and shapes. The segments 150 can define flow barriers that direct weep water toward the gates 152.

The gaps form the gates 152 to the recessed channels 148, allowing for fluid communication between the outer periphery of the flange section 116 and the drain opening 114 via the gates 152 and the recessed channels 148. Water trapped on the waterproof layer 108 around the floor drain system 100 can thus move through the gates 152 and recessed channels 148 between the clamping collar 104 and the drain body 102 toward the outlet or a drain pipe.

Figure 10:
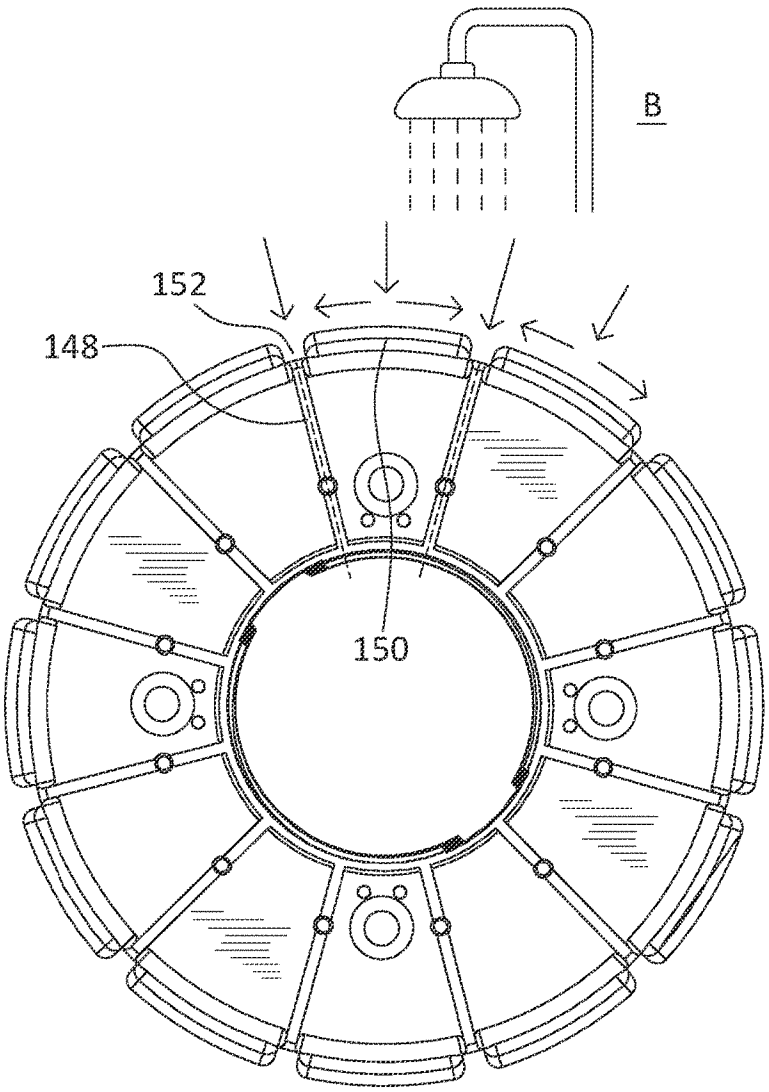
FIG. 10 shows a top view of clamping collar of FIG. 1.

FIG. 10 shows an exemplary installation of the floor drain system 100 installed in a shower B with a tiled floor. Over time, water from the shower B can work its way through the tile, mortar, and or grout to the waterproof layer 108 (shown in FIG. 7) beneath. Without the weep holes 146, recessed channels 148, segments 150 and or gates 152, weep water around the floor drain system 100 has little or no access to a drain pipe attached to the floor drain system 100. As the water moves over the waterproof layer 108 to the outer periphery of the clamping collar 104, the segments 150 and or protruding portions 140 engaging the waterproof layer 108 form flow barriers directing the water laterally towards the gates 152, allowing the water to pass through the gates 152 and access the recessed channels 148. The recessed channels 148 create space or flow paths between the clamping collar 104 and the waterproof layer 108 for the water to move toward the cylindrical section 142. If the cylindrical section 142 of the clamping collar 104 extends upward in relation to the drain body 102, the water can flow directly into the drain opening 114 of the drain body 102 and into a drain pipe. If the cylindrical section 142 of the clamping collar 104 extends down in the drain opening 114 of the drain body 102, the water can flow into the drain pipe through flow gaps 154 formed by the fastener receiving structures 130 between the drain opening 114 and the cylindrical section 142.

The weep features 145 of the floor drain system 100 thus improve drainage in the tile floor and reduces the likelihood of leaks and or water damage compared to prior art floor drains. Optionally, a weep protector can be included with the clamping collar 104 to reduce the likelihood of the drainage features from being blocked. Moreover, the size, number, and or arrangement of the weep features 145 can be varied based on different installment applications.

Figure 12:
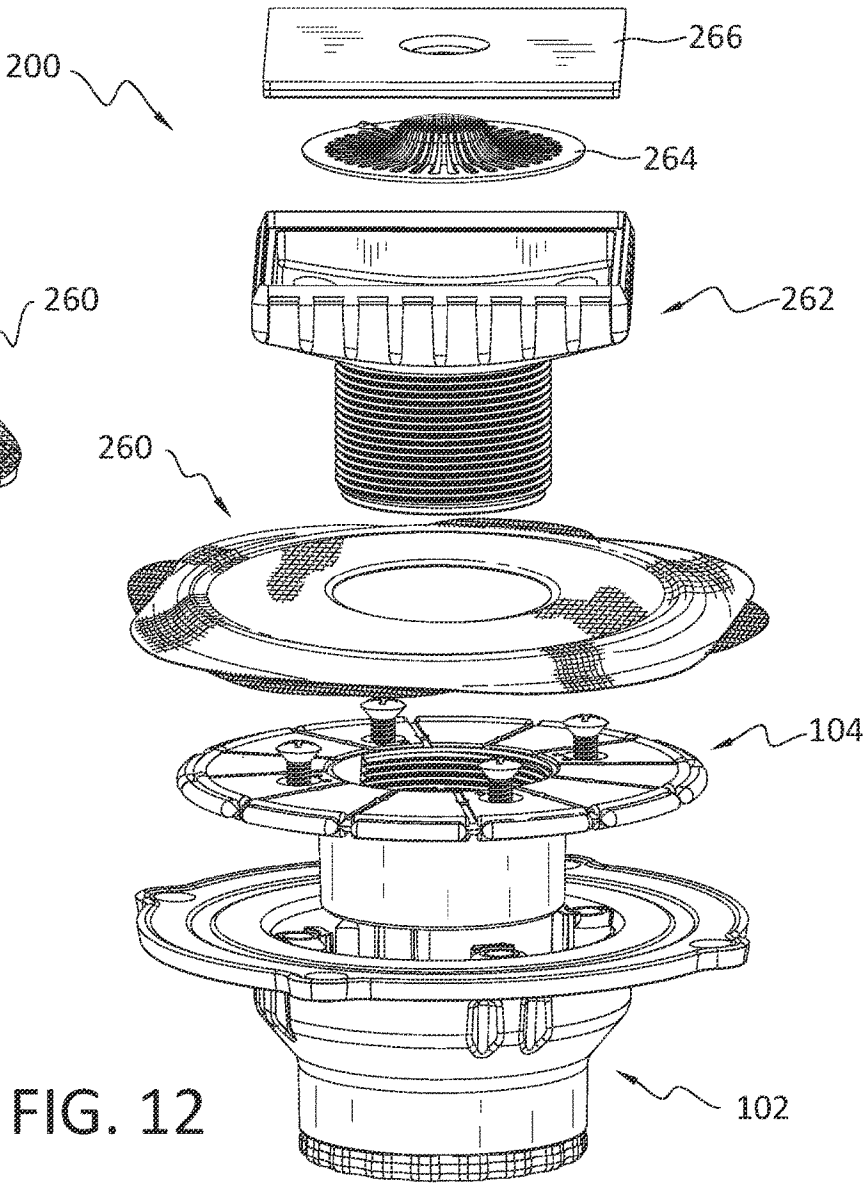
FIG. 12 shows an exploded view of the system of FIG. 11.
Figure 11:
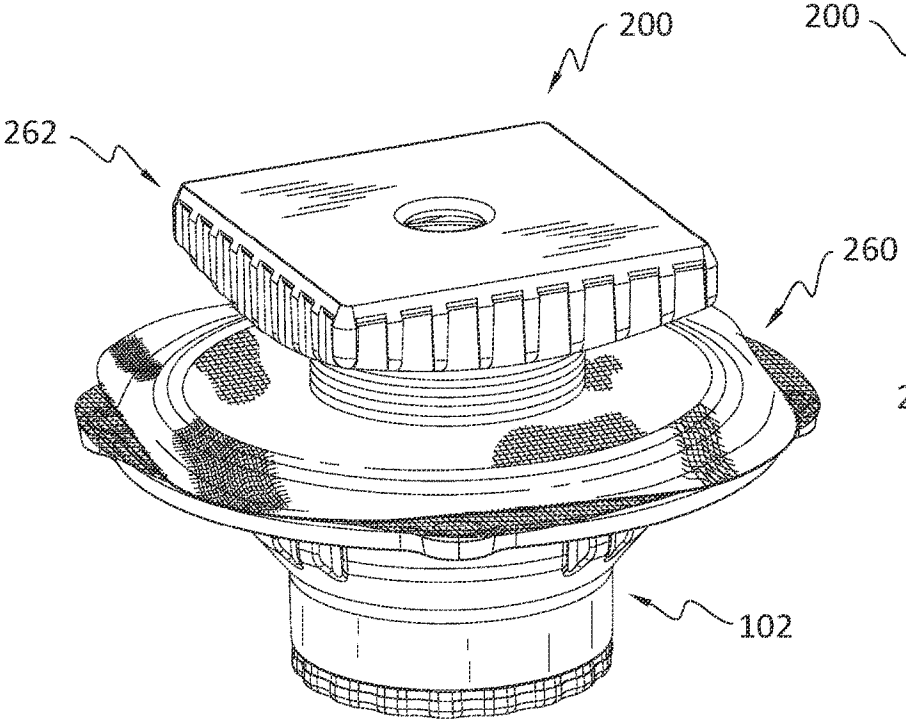
FIG. 11 shows a perspective view of a clamping collar drain system according to another embodiment.

FIGS. 11-16 illustrate a floor drain system 200 comprising a clamping collar drain system according to another embodiment. It will be appreciated that the floor drain system 200 can have the same or similar features as any of the embodiments described herein. As shown in FIGS. 11 and 12, the floor drain system 200 can include the drain body 102, the clamping collar 104, a weep protection system 260, a drain riser 262, a debris trap 264, and a drain cover comprising a construction plug 266. It will be appreciated the debris trap 264 can be optionally omitted and the drain riser 262 can comprise any suitable shape and configuration.

Figure 13:
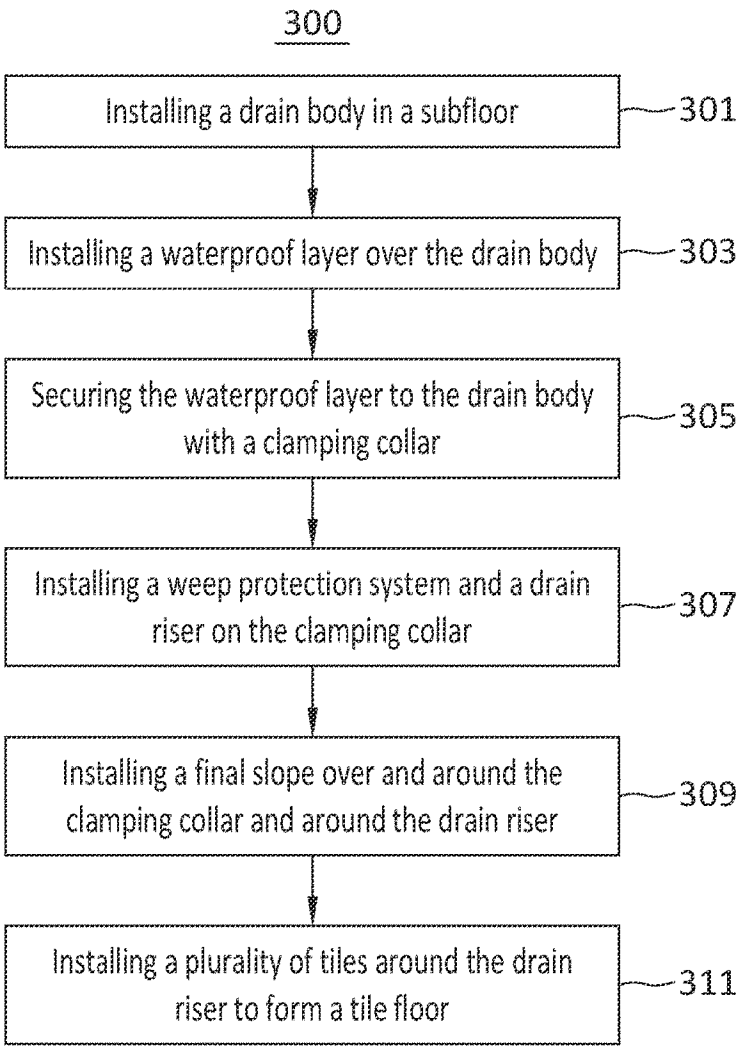
FIG. 13 is an overview of the steps in an embodiment of a floor drain system installation using the system of FIG. 11.

An exemplary installation 300 of the floor drain system 200 in a mud floor will now be described in reference to FIG. 13. A step 301 can include installing a drain body in a subfloor. This can include installing the drain body 102 in the subfloor. This can include cutting a cutout in the subfloor and positioning the drain body 102 in the cutout. As discussed above, because the fastener receiving structures 130 are located inside the drain opening 114 of the drain body 102, the cutout can be a simple circular cut and sized to closely fit the lower portion 110 of the drain body 102, streamlining installation and improving support of the drain body 102 by the subfloor. This step can also include securing the drain body 102 to the subfloor via fasteners through the openings 118 in the flange section 116 of the drain body 102. In an embodiment, step 301 can include attaching the drain body 102 to a drain pipe below the subfloor. Step 301 can include selecting a connector to connect the drain body 102 to the drain pipe based on the material forming the drain body 102 and or drain pipe. Step 301 can also include installing a shower pre-slope around the drain body 102.

Step 303 can include installing a waterproof layer over the drain body. This step can include installing the waterproof layer 108 over the drain body 102. This step can include cutting an opening in the waterproof layer 108 corresponding to the drain opening 114 of the drain body 102. Because the fastener receiving structures 130 are located inside the drain opening 114, cutting the opening in the waterproof layer 108 can be using a radiused edge of the sidewall of the drain opening 114 as a guide to form a simple circular cut versus having to locate fastener openings under the waterproof layer as common in the prior art. In other embodiments, the opening in the waterproof layer 108 can be pre-formed. This step can include applying a sealant in the recessed groove 136 around the flange section 116 before installing the waterproof layer 108.

Step 305 can include securing a waterproof layer with a clamping collar to the drain body. This can include inserting the fasteners 106 through the openings 128 of the clamping collar 104 and tightening the fasteners 106 into the fastener receiving structures 130 of the drain body 102. Because of the heel portions 134 on the inner side of the fastener receiving structures 130, the flange section 144 of the clamping collar 104 or tilt toward the flange section 116 as the fasteners 106 are tightened down, forcing the protruding portion 140 on the flange section 144 further into the recessed groove 136, improving and or strengthening the seal formed between the drain body 102 and the clamping collar 104.

Section 307 can include installing a weep protection system and a drain riser on the clamping collar. This step can include installing the weep protection system on the clamping collar 104 and threadedly attaching the drain riser 262 to the clamping collar 104. This step can include setting the drain riser 262 to a desired height. The drain riser 262 can include the debris trap 264 and the construction plug 266 comprising a construction plug. In an embodiment, the weep protection system can comprise the weep protection system 260 shown and described in greater detail in FIGS. 12 and 13.

Step 309 can include installing a final slope over the clamping collar and around the drain riser. In embodiment, the drain riser 262 can be higher than the final slope by a specific distance.

Step 311 can include installing a plurality of tiles around the drain riser to form a tile floor. This step can include installing tile with mortar and so it is flush with the construction plug 266. This step can include allowing the mortar to dry, and grouting with the construction plug 266 in place. In an embodiment, step 311 can include allowing the grout to dry before removing the construction plug 266. Step 311 can also include installing a drain cover comprising a drain grate on drain riser to complete the installation. The floor drain system 200 thus helps provide streamlined and improved installation of a drain system or other plumbing fixtures.

Figure 14:
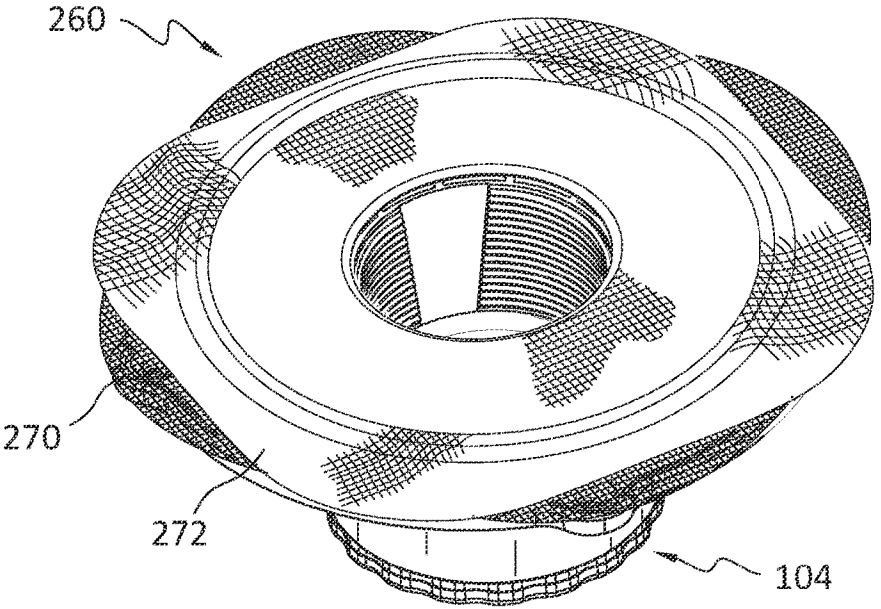
FIG. 14 is a perspective view of the weep protection system and clamping collar of FIG. 11.
Figure 15:
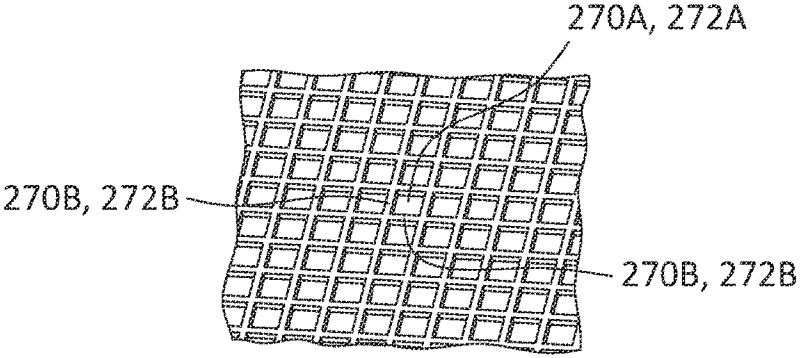
FIG. 15 is a detailed view of the weep protection system of FIG. 11.
Figure 16:
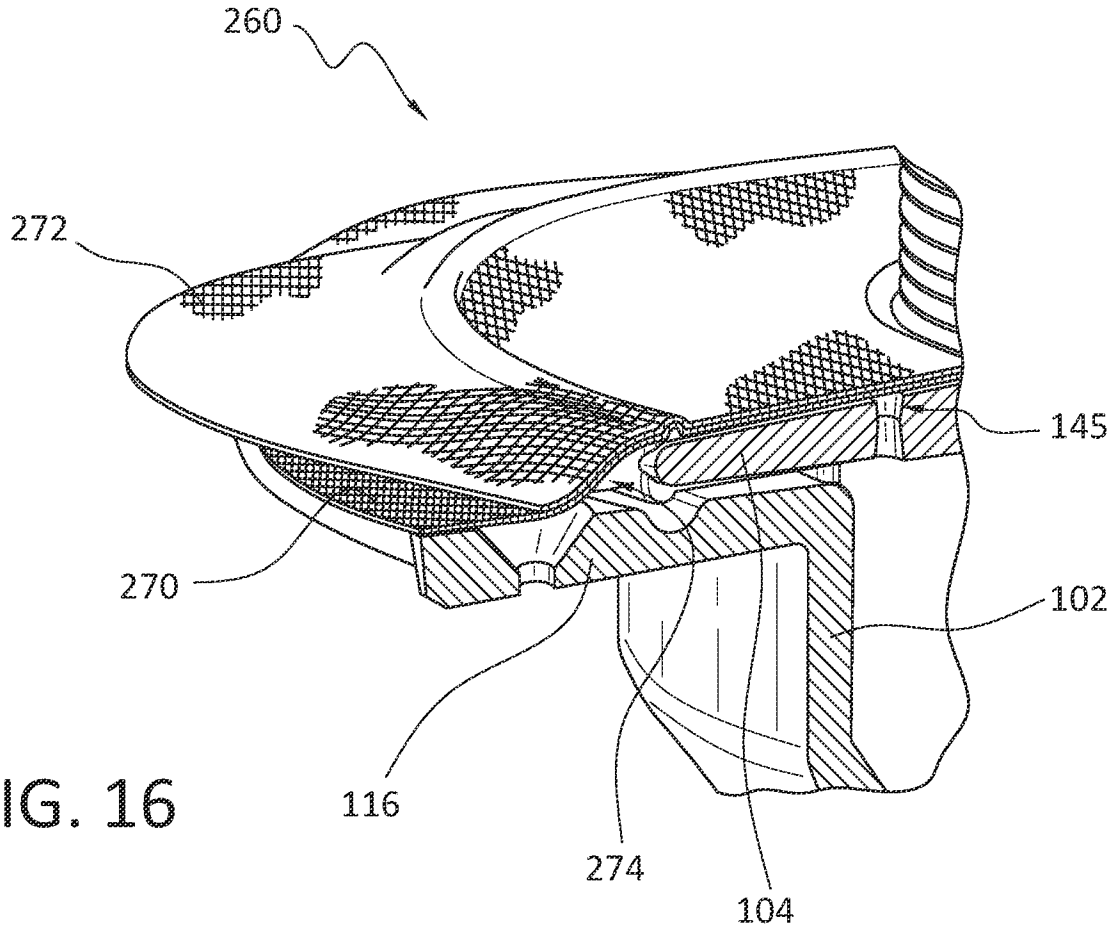
FIG. 16 shows a cross-section view of the system of FIG. 11.

FIGS. 14-16 show and describe an embodiment of the weep protection system 260 in additional detail. As described previously, the drain body 102 includes a plurality of weep features 145 configured to improve drainage and accommodate weep water moving through tile, mortar, grout, or other porous material in areas over and around the clamping collar 104. A widespread problem with weep features incorporated in prior art floor drains is blockage. If the water supply in a shower or other wet area contains high concentrations of lime and calcium, these minerals can build up in the drainage features until they are sealed and no longer able to direct the water toward a drain pipe. More commonly, the drainage features are inadvertently sealed with mortar when a new tile floor is installed over and around the floor drain system. The resulting water damage does not appear immediately, so an installer does not know there is a problem until long after an installation is finished.

The weep protection system 260 of the present disclosure can improve weep drainage in mortar bed constructed floors. It advantageously can help hold back dry pack mortar from entering the weep features 145 while still allowing water to pass through. Referring to FIG. 14, the weep protection system 260 includes a base screen member 270 positionable over the top of the clamping collar 104 and an upper screen member 272 positionable on the base screen member 270. Each of the base screen member 270 and the upper screen member 272 define a plurality of openings 271 and a plurality of segments 273 defining the openings 271 as shown in FIG. 15. The segments 273 can have a circular, rectangular, square, oval, triangular or any other suitable cross-sectional shape. In an embodiment, the openings 271 and the segments 273 can be the same size and or shape. In other embodiments, the openings 271 and the segments 273 can be different.

Optionally, the base screen member 270 and the upper screen member 272 include a large drain opening sized and configured to accommodate a cylindrical portion of the drain riser 262 such that the cylindrical portion of the drain riser 262 passes through the weep protection system 260 to attach to the clamping collar 104.

In an embodiment, the upper screen member 272 is rotated relative to the base screen member 270 such that the segments 273 of the base screen member 270 intersect the openings 271 of the upper screen member 272 and the segments 273 of the upper screen member 272 intersect the openings 271 of the base screen member 270. In an embodiment, the upper screen member 272 can be turned about 45 degrees in relation to the base screen member 270. In other embodiments, the upper screen member 272 can be turned about 35 and about 55 degrees in relation to the base screen member 270.

This misalignment between the base screen member 270 and the upper screen member 272 advantageously create axial and lateral passageways, including one or more turns through the weep protection system 260 that hold mortar and dry pack mortar from passing through the base screen member 270 and the upper screen member 272 while allowing weep water through the passageways and access the weep features 145 of the clamping collar 104. For example, the weep protection system 260 can include few if any straight paths extending in a vertical or axial through both the upper screen member 272 and the base screen member 270. Instead, axial, and lateral paths defined through the segments and openings wind or vary through the weep protection system 260, making it more likely that particles (e.g., dry pack mortar) will be captured or retained by the segments 273 of the weep protection system 260. This helps prevent the weep features 145 from being blocked by particles, while allows water to pass through lateral and other passageways in the weep protection system 260, which, in turn, improves drainage of the floor drain system 200. It will be appreciated that the size of the openings 271 can be selected based on the materials to be captured or blocked by the weep protection system 260.

In an embodiment, the base screen member 270 and the upper screen member 272 can have a flexible or semi-flexible configuration that allows the weep protection system 260 bridge over the top of the clamping collar 104 without draping tightly to the clamping collar 104 as shown in FIG. 15. Moreover, the base screen member 270 and the upper screen member 272 can be oversized in relation to the clamping collar 104 such that they extend or drape over at least a portion of the flange section 116 of the drain body 102 extending beyond the clamping collar 104. This advantageously helps create lateral passages 274 through and or below the weep protection system 260 for weep water to pass through. While the base screen member 270 and the upper screen member 272 are shown having rounded square shapes, it will be appreciated the screen members can have any suitable shape. For instance, the screen members can have a circular shape, on oval shape, or any other suitable shape.

The various aspects and embodiments disclosed herein are for purposes of illustration and are not intended to be limiting. For instance, while the weep protection system 260 is described as including two members, in other embodiments the weep protection system can include one, three, or any other number of members defining indirect, divided, or winding passages therethrough. Additionally, the words "including," "having," and variants thereof (e.g., "includes" and "has") as used herein, including the claims, shall be open ended and have the same meaning as the word "comprising" and variants thereof (e.g., "comprise" and "comprises").

The invention claimed is:

1. A floor drain system comprising:

a drain body including a drain opening and arranged for attachment to a drain pipe and installation in a subfloor; and a clamping collar arranged for securing a waterproof layer to the drain body, wherein the drain body includes a plurality of fastener receiving structures along an inner side of the drain opening and including threaded openings located radially inside of the drain opening for receiving a plurality of fasteners to attach the clamping collar to the drain body and seal the waterproof layer between the drain body and the clamping collar, wherein each of the fastener receiving structures include a heel portion extending upward along a radial inner side of the fastener receiving structure and above the threaded opening.

2. The system of claim 1, wherein the fastener receiving structures extend axially along an inner wall of the drain opening and are arranged to support and locate a portion of the clamping collar in the drain opening.

3. The system of claim 1, wherein the heel portions tilt a portion of a flange section on the clamping collar toward the drain body to increase a seal formed by the waterproof layer between the drain body and the clamping collar when the clamping collar is tightened onto the drain body.

4. The system of claim 1, wherein an outer periphery of the clamping collar defines a plurality of segments separated by a plurality of gates extending circumferentially around the clamping collar.

5. The system of claim 4, wherein the segments define flow barriers arranged to direct weep water toward the gates.

6. The system of claim 5, wherein the gates are in fluid communication with the drain opening of the drain body, and wherein weep water passes through the gates to drain into the drain pipe.

7. The system of claim 5, wherein the gates along the outer periphery are in fluid communication with the drain opening of the drain body via one or more recessed channels defined on the clamping collar.

8. The system of claim 7, wherein at least one of the recessed channels defines at least one weep hole.

9. The system of claim 1, further comprising a weep protection system comprising a base screen member positionable on the clamping collar and an upper screen member positionable on the base screen member so that the upper screen member is rotated relative to the base screen member.

10. The system of claim 9, wherein each of the upper screen member and the base screen member include a plurality of segments defining a plurality of openings, and the segments of the upper screen member intersect the openings of the base screen member.

11. The system of claim 9, wherein the upper screen member is rotated about 45 degrees relative to the base screen member.

12. The system of claim 9, wherein the base screen member and the upper screen member extend radially beyond the clamping collar.

13. The system of claim 9, wherein the weep protection system is arranged to hold back dry back mortar from blocking drainage features on the clamping collar while weep water pass through the weep protection system.

14. A floor drain system comprising:

a drain body including a drain opening and arranged for attachment to a drain pipe and installation in a subfloor;

a clamping collar arranged for securing a waterproof layer to the drain body, wherein the drain body includes a plurality of fastener receiving structures along an inner side of the drain opening and including threaded openings located radially inside of the drain opening for receiving a plurality of fasteners to attach the clamping collar to the drain body and seal the waterproof layer between the drain body and the clamping collar, wherein the fastener receiving structures extend axially along an inner wall of the drain opening and are arranged to support and locate a portion of the clamping collar in the drain opening, wherein one or more of the fastener receiving structures include a heel portion extending upward along a radial inner side of the fastener receiving structure and above the threaded opening; and a weep protection system comprising a base screen member positionable on the clamping collar and an upper screen member positionable on the base screen member so that the upper screen member is rotated relative to the base screen member.

15. The system of claim 14, wherein an outer periphery of the clamping collar defines a plurality of segments separated by a plurality of gates extending circumferentially around the clamping collar.

16. The system of claim 14, wherein the heel portion tilts a portion of a flange section on the clamping collar toward the drain body to increase a seal formed by the waterproof layer between the drain body and the clamping collar when the clamping collar is tightened onto the drain body.

17. A floor drain system comprising:

a drain body including a drain opening and arranged for attachment to a drain pipe and installation in a subfloor; and a clamping collar arranged for securing a waterproof layer to the drain body, wherein the drain body includes a plurality of fastener receiving structures along an inner side of the drain opening and including threaded openings located radially inside of the drain opening for receiving a plurality of fasteners to attach the clamping collar to the drain body and seal the waterproof layer between the drain body and the clamping collar, wherein the fastener receiving structures extend axially along an inner wall of the drain opening and are arranged to support and locate a portion of the clamping collar in the drain opening, wherein each of the fastener receiving structures include a heel portion extending upward along a radial inner side of the fastener receiving structure and above the threaded opening.

* * * * *